US009086212B2

(12) United States Patent
Yang et al.

(10) Patent No.: US 9,086,212 B2
(45) Date of Patent: Jul. 21, 2015

(54) LED BULB AND LAMP HEAD STRUCTURE

(71) Applicant: Amphenol LTW Technology Co., Ltd., New Taipei (TW)

(72) Inventors: Chih-Huan Yang, New Taipei (TW); Alan Michael Jamisolamin Sundo, New Taipei (TW)

(73) Assignee: AMPHENOL LTW TECHNOLOGY CO., LTD., New Taipei (TW)

( * ) Notice: Subject to any disclaimer, the term of this patent is extended or adjusted under 35 U.S.C. 154(b) by 82 days.

(21) Appl. No.: 14/022,055

(22) Filed: Sep. 9, 2013

(65) Prior Publication Data

US 2015/0070910 A1 Mar. 12, 2015

(51) Int. Cl.

| | |
|---|---|
| ***H01R 33/02*** | (2006.01) |
| ***F21V 19/04*** | (2006.01) |
| ***F21V 19/00*** | (2006.01) |
| ***F21K 99/00*** | (2010.01) |
| *F21Y 101/02* | (2006.01) |
| *F21V 3/00* | (2015.01) |
| *F21V 23/00* | (2015.01) |
| *F21V 23/06* | (2006.01) |

(52) U.S. Cl.

CPC ..... *F21V 19/045* (2013.01); *F21K 9/1355* (2013.01); *F21V 19/004* (2013.01); *F21V 19/005* (2013.01); *F21V 3/00* (2013.01); *F21V 23/006* (2013.01); *F21V 23/06* (2013.01); *F21Y 2101/02* (2013.01)

(58) Field of Classification Search

CPC ..... H01R 33/94; H01R 33/22; H01R 2201/08

USPC ..... 439/236, 611, 620.02

See application file for complete search history.

(56) References Cited

U.S. PATENT DOCUMENTS

| | | | | | |
|---|---|---|---|---|---|
| 953,708 | A * | 4/1910 | Platt | 439/646 |
| 953,709 | A * | 4/1910 | Platt | 439/646 |
| 1,123,002 | A * | 12/1914 | Platt | 439/646 |
| RE15,043 | E * | 2/1921 | Peterson | 439/646 |
| 1,484,494 | A * | 2/1924 | Harrington | 439/646 |
| 1,567,686 | A * | 12/1925 | Swenson | 439/300 |
| 6,011,347 | A * | 1/2000 | Wittmann | 313/318.09 |
| 7,341,469 | B2 * | 3/2008 | Frye | 439/236 |
| 7,892,031 | B1 * | 2/2011 | Mostoller et al. | 439/611 |
| 2006/0076870 | A1 * | 4/2006 | Kurokawa et al. | 313/318.01 |
| 2012/0225589 | A1 * | 9/2012 | Bologna | 439/661 |

* cited by examiner

*Primary Examiner* — Tho D Ta

(74) *Attorney, Agent, or Firm* — Chun-Ming Shih; HDLS IPR Services

(57) ABSTRACT

The present invention provides an LED bulb and a lamp head structure hereof. The lamp head structure includes an insulating seat, a first conducting plate, a second conducting plate and a conducting piece. The insulating seat has a first accommodating space and a second accommodating space separately arranged and an opening slot communicating with the second accommodating space. The first conducting plate is accommodated in the first accommodating space. One end of the conducting piece inserted in the first conducting plate is electrically conducted with each other, and the other end is protruded out of the insulating seat. The insulating seats could be provided for different types of LED bulb. Thus the development time will be shortened, and the production cost will be reduced.

7 Claims, 7 Drawing Sheets

LED BULB AND LAMP HEAD STRUCTURE

BACKGROUND OF THE INVENTION

1. Field of the Invention

The present invention generally relates to a lamp head structure and, in particular to a lamp head assembly applied in an LED bulb.

2. Description of Related Art

Because LEDs have characteristics of quick response, small size and low pollution etc., LEDs gradually replace incandescent lamps for saving energy and protecting environment.

Commercially available LED bulb has a lamp base and a lamp head connecting with the lamp base. An LED assembly is disposed in the lamp base. A conducting threaded section and an electrical bump are provided on the lamp head. Moreover, two wires are accommodated in the lamp base. One end of one wire is soldered on the circuit board, and the other end is soldered on a conducting threaded section. Besides, one end of the other wire is soldered on the circuit board, and the other end is soldered on the electrical bump for configuring a circuit loop.

However, an electrically connection of the above LED bulb is achieved through a soldering process. According to the soldering process is complicated, the operating time and the assembly cost will be increased. Furthermore, because LED bulbs have a lot of models, lamp bases and lamp heads must have corresponding structures which result in a long development schedule.

In view of the above drawbacks, the Inventor proposes the present invention based on his expert knowledge and elaborate researches in order to solve the problems of related art.

SUMMARY OF THE INVENTION

Accordingly, an object of the present invention is to provide a lamp head structure, which the two conducting plates are disposed in the insulating seat, and the insulating seats could be provided for different types of LED bulb. Thus the development time will be shortened, and the production cost will be reduced.

In order to achieve the object mentioned above, the present invention provides a lamp head structure for combining with a lamp base. The lamp head structure comprises an insulating seat, a first conducting plate, a second conducting plate and a conducting piece. The insulating seat includes a first accommodating space and a second accommodating space separately arranged and an opening slot communicating with the second accommodating space. The first conducting plate is accommodated in the first accommodating space. One end of the first conducting plate is fixed in the insulating seat, and the other end is bent to form a first elastic arm. The second conducting plate is accommodated in the second accommodating space. One end of the second conducting plate is protruded out of the opening slot, and the other end is bent to form a second elastic arm. One end of the conducting piece inserted in the first conducting plate is electrically conducted with each other, and the other end is protruded out of the insulating seat.

Another object of the present invention is to provide an LED bulb, which the lamp head structure could be provided for different types of LED bulb, and an ease of the assembly will be achieved.

In order to achieve the object mentioned above, the present invention provides a lamp head structure, an insulating seat, a lighting module and a lamp shell. The lamp head structure comprises an insulating seat, a first conducting plate, a second conducting plate and a conducting piece. The insulating seat includes a first accommodating space and a second accommodating space separately arranged and an opening slot communicating with the second accommodating space. The first conducting plate is accommodated in the first accommodating space. One end of the first conducting plate is fixed in the insulating seat, and the other end is bent to form a first elastic arm. The second conducting plate is accommodated in the second accommodating space. One end of the second conducting plate is protruded out of the opening slot, and the other end is bent to form a second elastic arm. One end of the conducting piece is inserted and electrically conducted with the first conducting plate, and the other end is protruded out of the insulating seat.

Comparing to the related art, the first conducting plate and the second conducting plate of the lamp head structure of the present invention are both disposed in the insulation seat. The lamp head structure can make design changes by different types of lamps. Thus the development time will be shortened, and the production cost will be reduced for enhancing the ease of the assembly.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
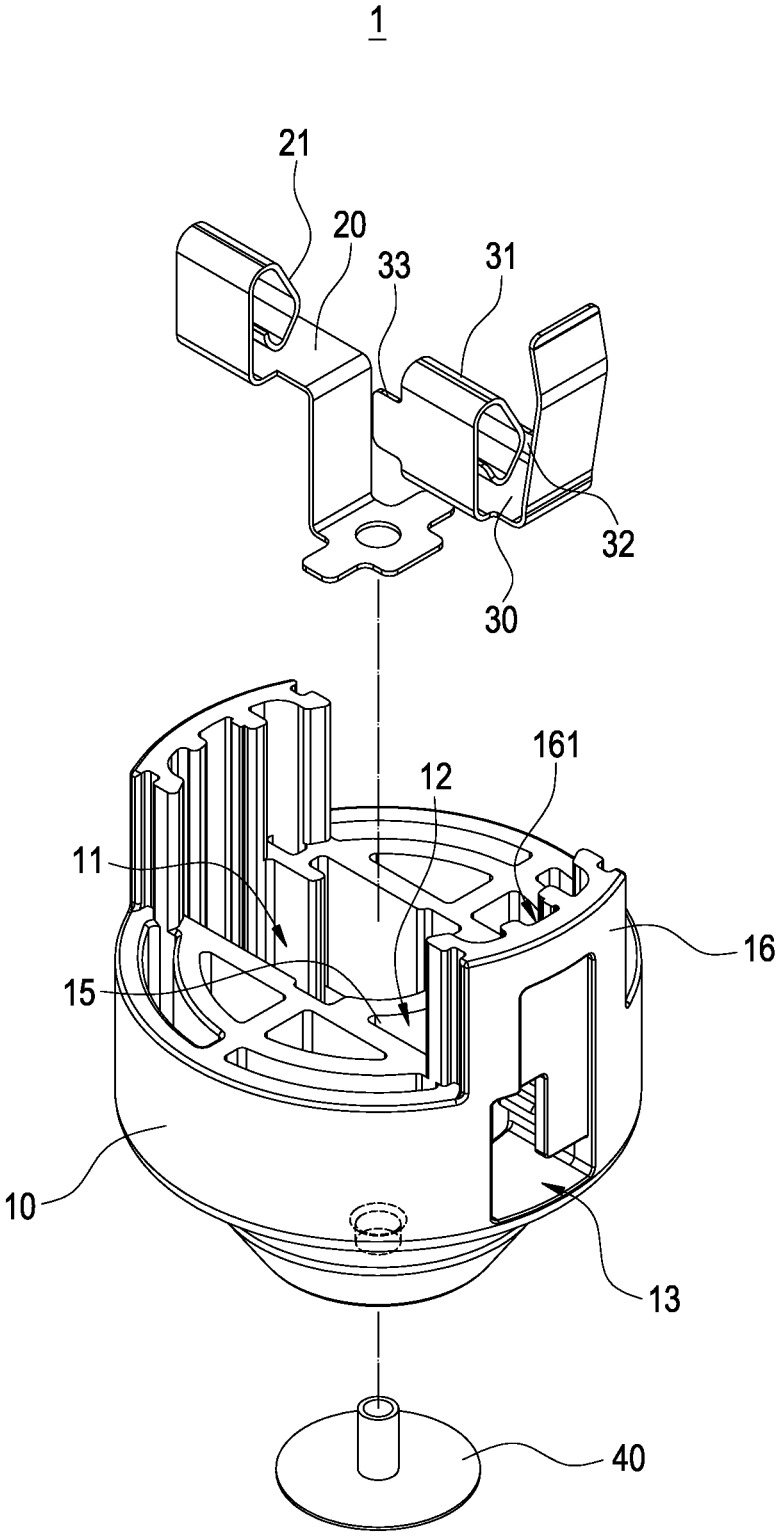
FIG. 1 is a perspective explosion schematic view of lamp head structure of the present invention.
Figure 2:
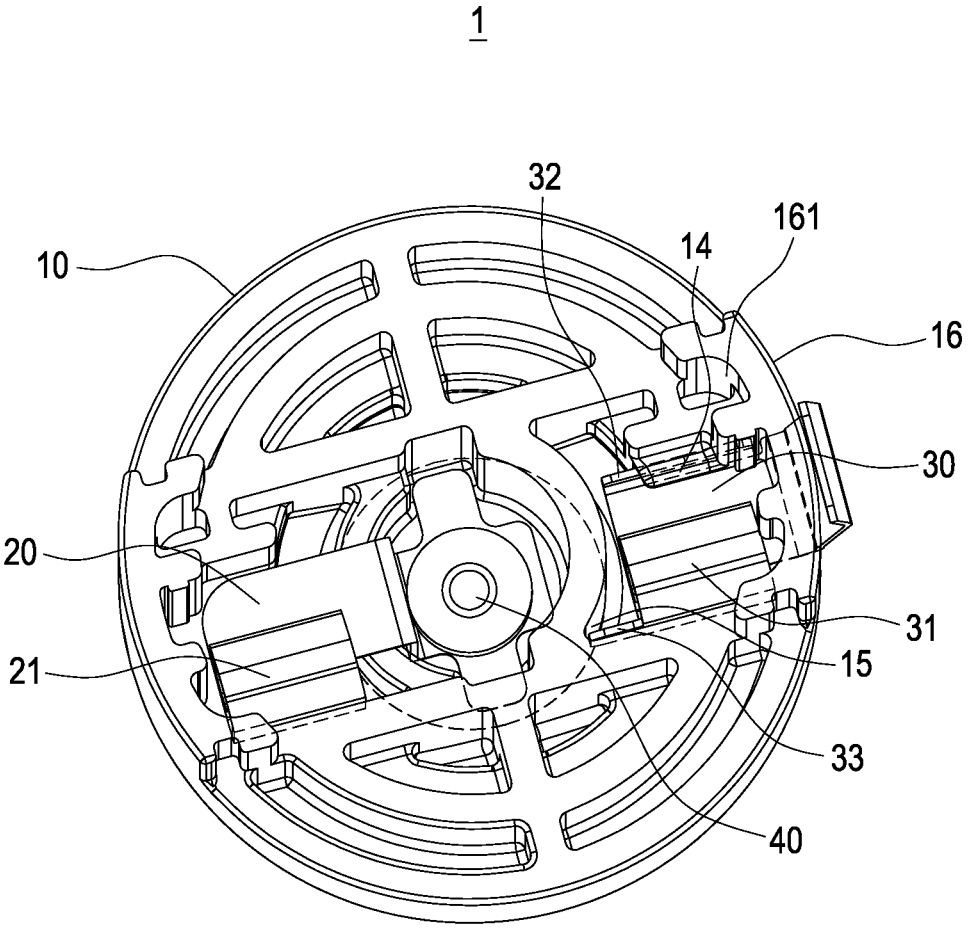
FIG. 2 is a perspective schematic view of lamp head structure of the present invention.

Please refer to FIG. 1 and FIG. 2, they depict a perspective explosion schematic view and a perspective schematic view of lamp head structure of the present invention. The lamp head structure 1 includes an insulating seat 10, a first conducting plate 20, a second conducting plate 30 and a conducting piece 40. The first conducting plate 20 and the second conducting plate 30 are separately disposed in the insulating seat 10.

The insulating seat 10 includes a first accommodating space 11 and a second accommodating space 12 separately arranged and an opening slot 13 communicating with the second accommodating space 12. Moreover, the first conducting plate 20 is accommodated in the first accommodating space 11. One end of the first conducting plate 20 is fixed in the in the bottom of the insulating seat 10 inside, and the other end is bent to form a first elastic arm 21. Besides, the second conducting plate 30 is accommodated in the second accommodating space 12. One end of the second conducting plate 30 is protruded out of the opening slot 13, and the other end is bent to form a second elastic arm 31.

The conducting piece 40 could be, but not limited to, a rivet. One end of the conducting piece 40 is inserted in the first conducting plate 20. The conducting piece 40 is electrically conducted with the first conducting plate 20, and the other end of the conducting piece 40 is protruded out of the insulating seat 10 for electrically connection.

The insulating seat 10 is provided with a hook 14 in a side of the second accommodating space 12. One side of the second conducting plate 30 is formed with a buckle 32, and the hook 14 is latched on the buckle 32. Furthermore, the insulating seat 10 has a notch 15 in another side of the second accommodating space 12. One side of the second conducting plate 30 is formed with a bump 33, and the bump 33 is stuck in the notch 15.

The first conducting plate 20 is combined in the insulating seat 10 through the conducting piece 40. On the other hand, the second conducting plate 30 is combined in the insulating seat 10 through the hook 14 of the insulating seat 10 snapping with the buckle 32 of the second conducting plate 30.

Figure 3:
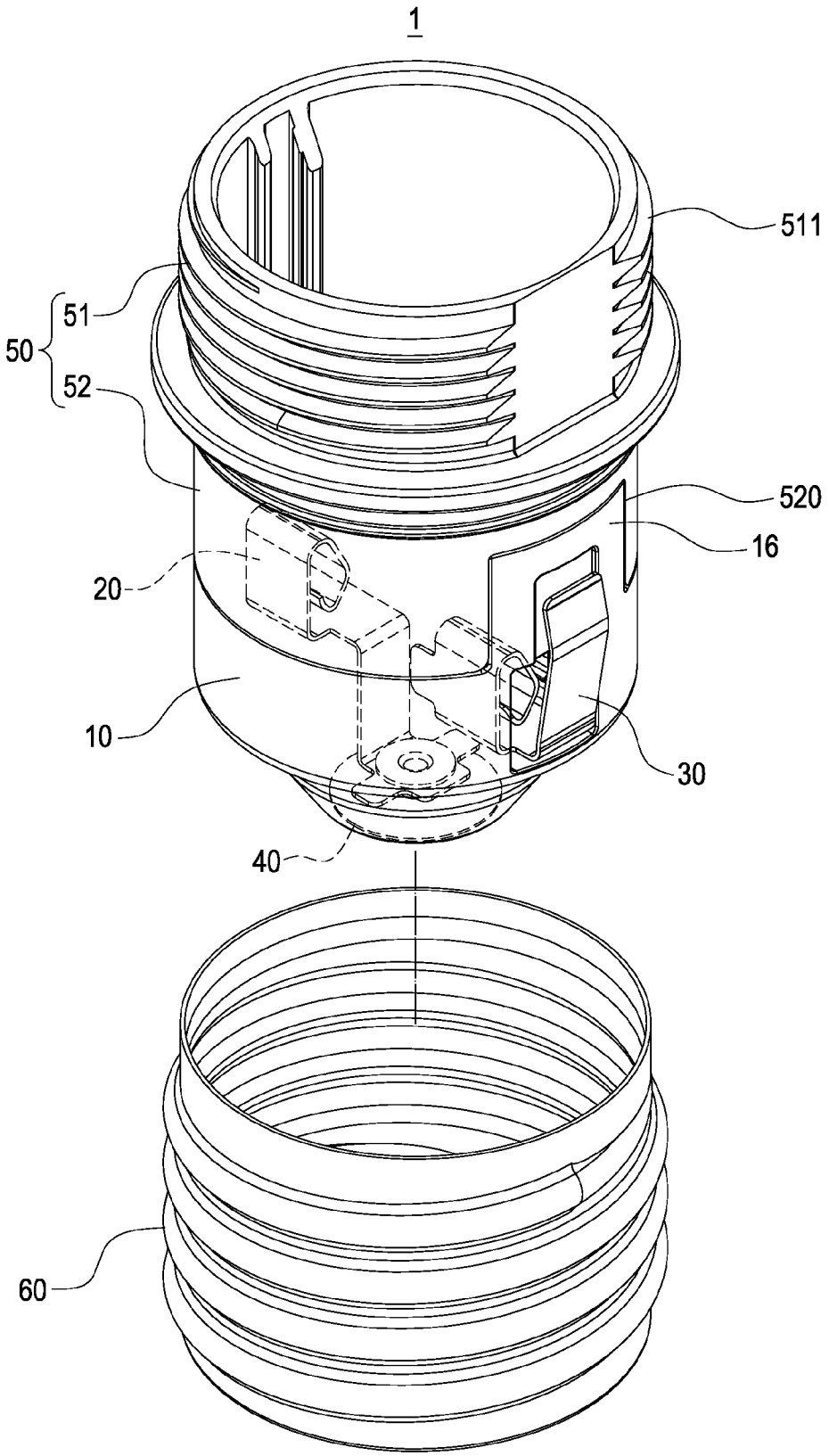
FIG. 3 is another perspective schematic view of lamp head structure of the present invention.
Figure 4:
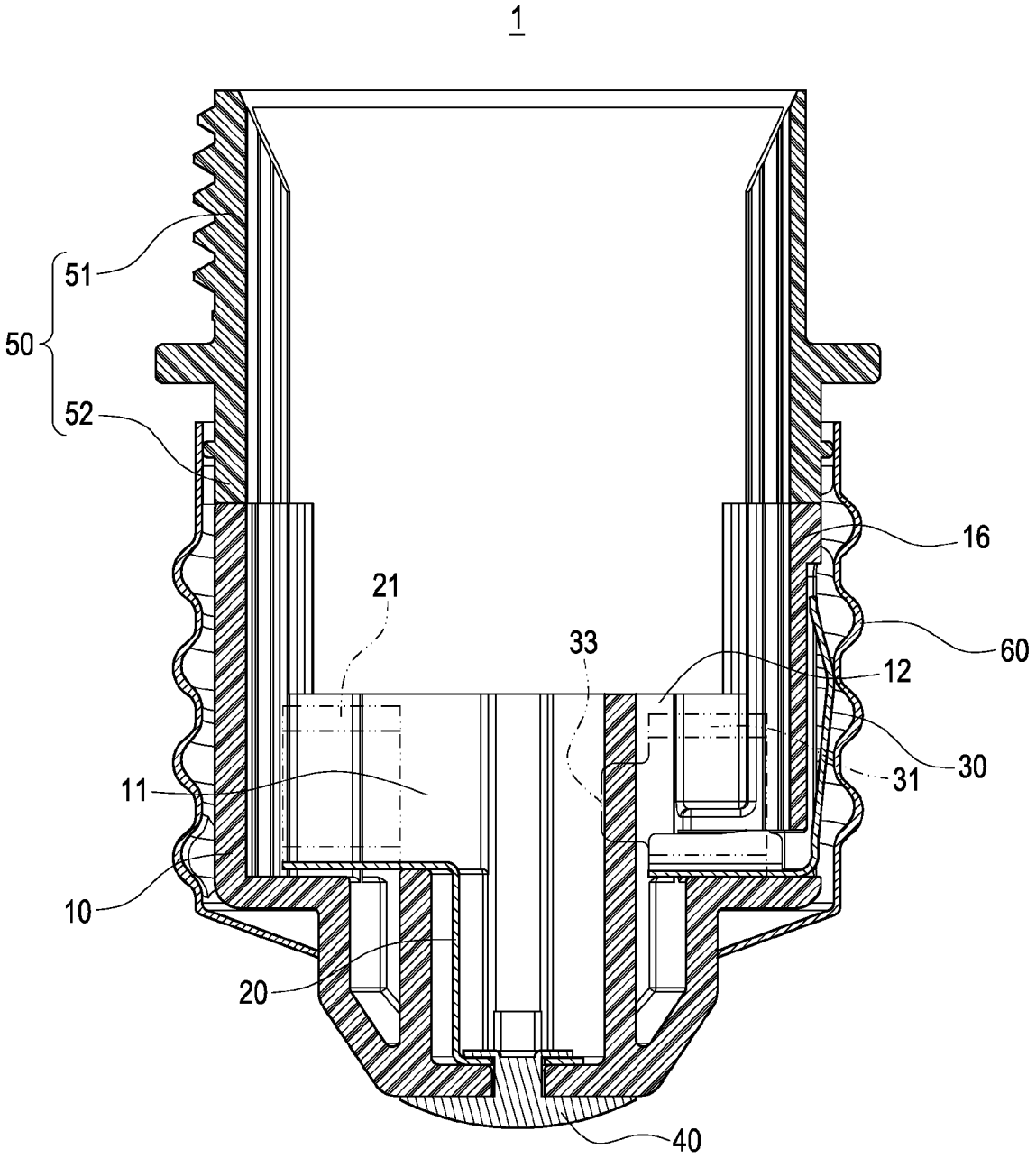
FIG. 4 is an assembly cross sectional views of another side of lamp head structure of the present invention.

Please also refer to FIG. 3 and FIG. 4, they depict another perspective schematic view and an assembly cross sectional view of lamp head structure of the present invention. In the present invention, the lamp head structure 1 further includes a supporting barrel 50 and a conducting ring 60. The supporting barrel 50 has a receiving section 51 and an assembling section 52 connected with the insulating seat 10. The assembling section 52 is extended from the receiving section 51, and a plural of threads 511 are provided on an outer surface of the receiving section 51. An outer surface of the conducting ring 60 is configured in a wave shape, and the conducting ring 60 is sleeved on the insulating seat 10 and conducted with the second conducting plate 30.

In an embodiment of the present invention, an end of the insulating seat 10 is formed with at least one inserting plate 16. The assembling section 52 has an inserting slot 520 corresponding to the inserting plate 16, and the supporting barrel 50 is assembled on the insulating seat 10 through a positioning of the inserting slot 520 and the inserting plate 16.

Figure 5:
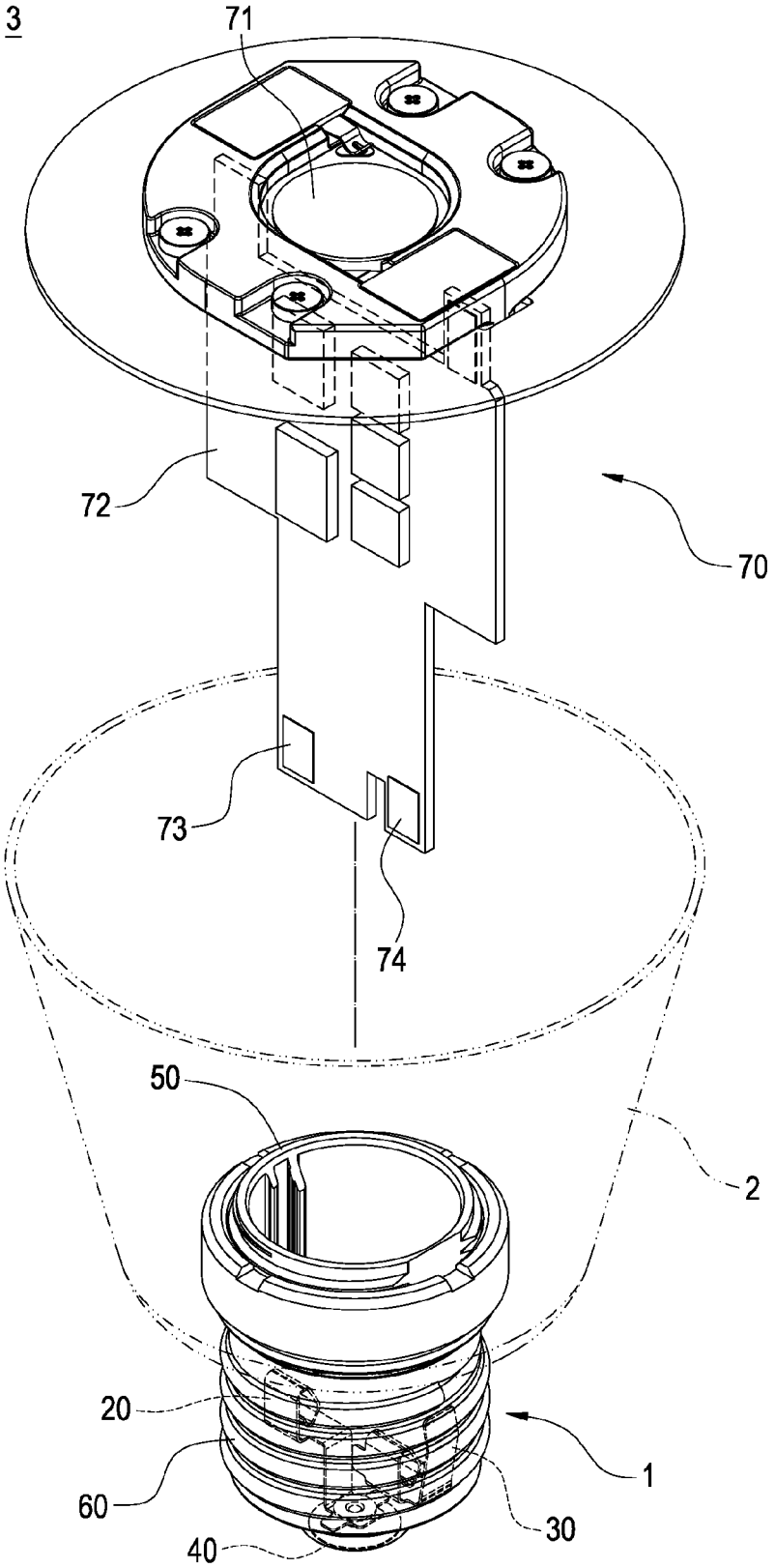
FIG. 5 is a partial explosion view of an LED lamp of the present invention.
Figure 6:
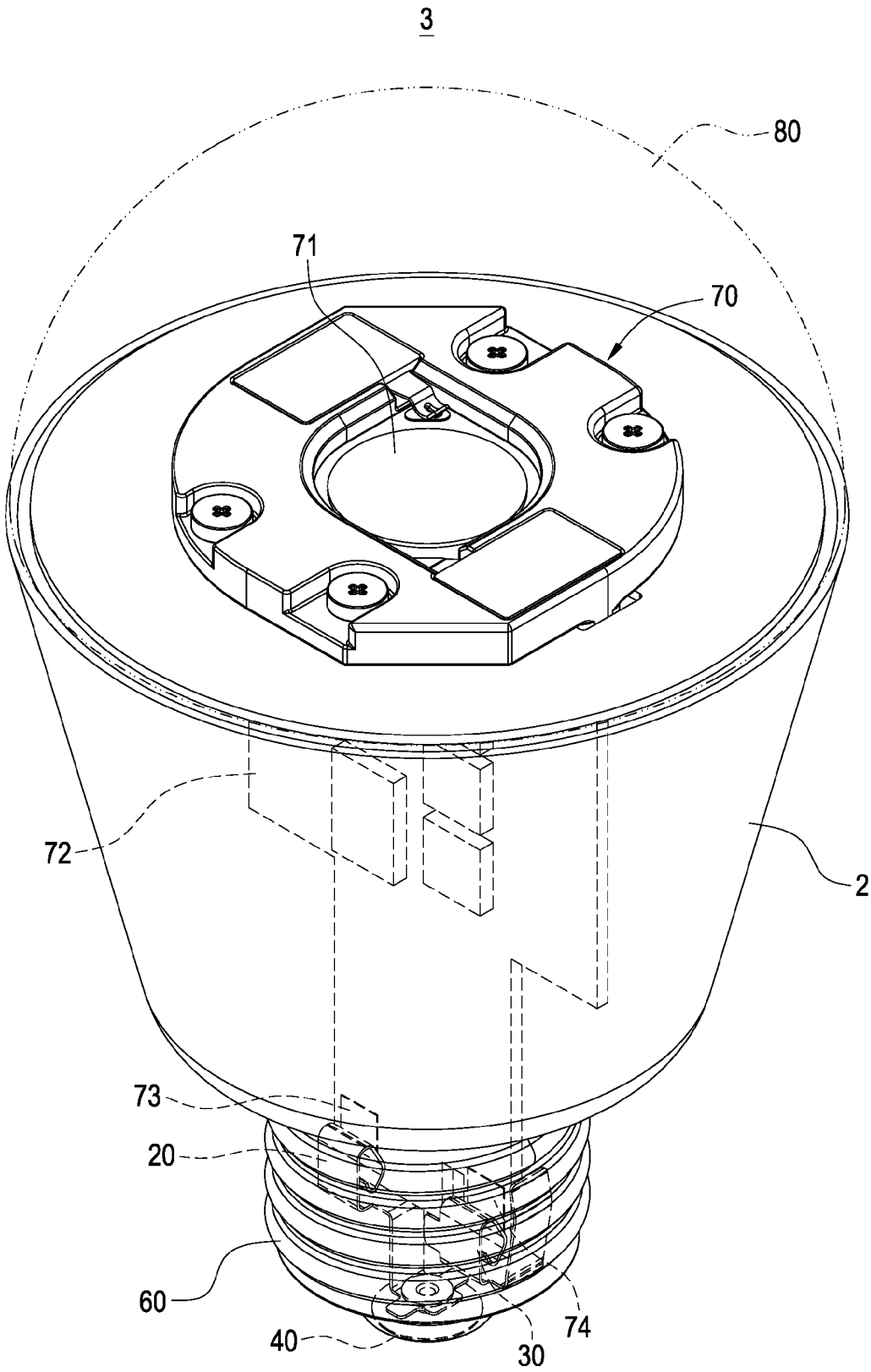
FIG. 6 is a perspective schematic view of an LED lamp of the present invention.
Figure 7:
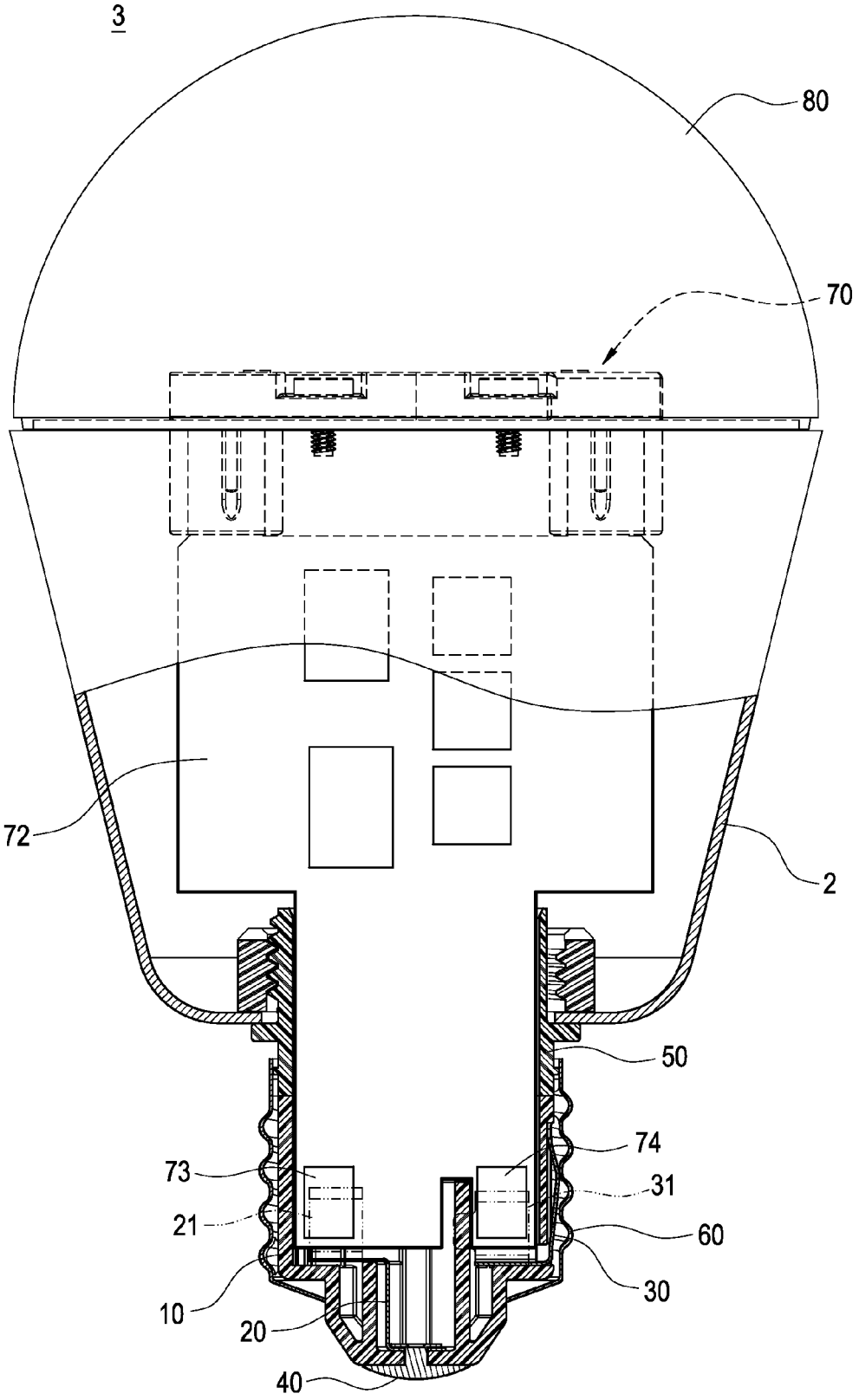
FIG. 7 is an assembly cross sectional view of an LED lamp of the present invention.

With referring to FIG. 5 to FIG. 7, they depict a partial perspective explosion schematic view, a perspective schematic view and an assembly cross sectional view of an LED bulb of the present invention. The lamp head structure 1 is applied to combine with a lamp base 2 for constituting an LED bulb 3.

In an embodiment of the present invention, the LED bulb 3 comprises a lamp head structure 1, a lamp base 2, a lighting module 70 and a lamp shell 80. The lamp head structure 1 includes an insulating seat 10, a first conducting plate 20, a second conducting plate 30, a conducting piece 40 and a supporting barrel 50.

The lamp base 2 assembled on the supporting barrel 50 could be provided as a heat sink, and the lighting module 70 is disposed in the lamp base 2.

The lighting module 70 includes an LED assembly 71, a circuit board 72 electrically connected with the LED assembly 71 and a first conducting pad 73 and a second conducting pad 74 provided on the circuit board 72. The lamp shell 80 is a transparent shell, and the lamp shell 80 is disposed on the lamp base 2 for covering the LED assembly 71.

In the present embodiment, an inner surface of the inserting plate 16 of the insulating seat 10 is formed with a plural of grooves 161 (refer to FIG. 1), and two lateral sides of the circuit board 72 are inserted in the grooves 161. The first conducting pad 73 of the circuit board 72 is electrically connected with the first elastic arm 31 of the first conducting plate 20, and the second conducting pad 74 is electrically connected with the second elastic arm 31 of the second conducting plate 30. Thus the circuit board 72 is assembled in the lamp base 2 for achieving the electricity connection without a soldering process.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A lamp head structure for combining with a lamp base, the lamp head structure comprising:

an insulating seat including a first accommodating space and a second accommodating space separately arranged and an opening slot communicating with the second accommodating space, wherein two inserting plates are protruded out of a top end of the insulating seat to form a partial periphery wall;

a first conducting plate accommodated in the first accommodating space, one end of the first conducting plate fixed in the insulating seat and the other end being bent to form a first elastic arm;

a second conducting plate accommodated in the second accommodating space, one end of the second conducting plate protruded out of the opening slot and the other end being bent to form a second elastic arm;

a conducting piece having one end inserted and electrically conducted the first conducting plate and the other end protruded out of the insulating seat; and a supporting barrel having a receiving section connected with the lamp base, an assembling section connected with the insulating seat, and a flange formed between the receiving section and the assembling section, wherein a plural of threads are provided on an outer surface of the receiving section, the assembling section has two inserting slots corresponding to the two inserting plates, respectively, and the supporting barrel is assembled on the insulating seat through a positioning of the inserting slot and the inserting plate.

2. The lamp head structure according to claim 1, wherein the insulating seat is provided with a hook in a side of the second accommodating space, one side of the second conducting plate is formed with a buckle, the hook is latched on the buckle.

3. The lamp head structure according to claim 1, wherein the insulating seat having a notch in another side of the second accommodating space, one side of the second conducting plate is formed with a bump stuck in the notch.

4. The lamp head structure according to claim 1, wherein the conducting piece is a rivet with a head disposed on an outer surface of a bottom end of the insulating seat and a tail holding the one end of the first conducting plate on an inner surface of the bottom end of the insulating seat.

5. The lamp head structure according to claim 1, further including a conducting ring, the conducting ring is sleeved on the insulating seat and conducted with the second conducting plate.

6. An LED bulb, comprising:

a lamp head structure, including:

an insulating seat including a first accommodating space and a second accommodating space separately arranged and an opening slot communicating with the second accommodating space, wherein two inserting plates are protruded out of a top end of the insulating seat of the insulating seat to form a partial periphery wall;

a first conducting plate fixed in the first accommodating space;

a second conducting plate fixed in the second accommodating space;

a conducting piece having one end inserted and electrically conducted the first conducting plate and the other end protruded out of the insulating seat; and a supporting barrel having a receiving section connected with the lamp base, an assembling section connected with the insulating seat, and a flange formed between the receiving section and the assembling section, wherein a plural of threads are provided on an outer surface of the receiving section, the assembling section has two inserting slots corresponding to the two inserting plates, respectively, and the supporting barrel is assembled on the insulating seat through a positioning of the inserting slot and the inserting plate;

a lamp base assembled on the supporting barrel;

a lighting module disposed in the lamp base, the lighting module including an LED assembly, a circuit board electrically connected with the LED assembly and a first conducting pad and a second conducting pad provided on the circuit board, the first conducting pad is electrically connected with the first conducting plate, and the second conducting pad is electrically connected with the second conducting plate; and a lamp shell disposed on the lamp base for covering the LED assembly.

7. The LED bulb according to claim 6, wherein an inner surface of the inserting plate is formed with a plural of grooves, and two lateral sides of the circuit board are inserted in the grooves.

* * * * *